US006896550B2

(12) United States Patent
Li

(10) Patent No.: US 6,896,550 B2
(45) Date of Patent: May 24, 2005

(54) CABLE CONNECTOR ASSEMBLY WITH AUXILIARY MECHANISM IN MOLDING PROCESS

(75) Inventor: Bin Li, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/877,717

(22) Filed: Jun. 25, 2004

(65) Prior Publication Data

US 2004/0266262 A1 Dec. 30, 2004

(30) Foreign Application Priority Data

Jun. 25, 2003 (TW) ..... 92211560 U

(51) Int. Cl.[7] ..... H01R 13/40
(52) U.S. Cl. ..... 439/604
(58) Field of Search ..... 439/604, 605, 439/606

(56) References Cited

U.S. PATENT DOCUMENTS 4,764,121 A * 8/1988 Ditzig ..... 439/21
4,769,906 A * 9/1988 Purpura et al. ..... 29/857
4,834,487 A * 5/1989 Abendschein et al. ..... 385/78
5,334,044 A * 8/1994 Falossi et al. ..... 439/491
5,600,885 A 2/1997 Schroepfer et al.
6,113,400 A 9/2000 Martin et al.
6,123,572 A 9/2000 Ishii et al.

* cited by examiner

*Primary Examiner*—Gary Paumen
*Assistant Examiner*—James R. Harvey
(74) *Attorney, Agent, or Firm*—Wei Te Chung

(57) ABSTRACT

A cable connector (100) includes an insulative housing (1), a number of terminals, a signal transmission cable (2), and two engaging blocks (3). The insulative housing comprises a mating end (12), a cable insertion end (13), and a cable receiving cavity (15). Each engaging block defines a concave inside face. One end of the signal transmission cable is received in the receiving cavity. The blocks are filled in the cavity and the concave inside face abuts against the outer periphery of the cable. A jacket (4) is molded on the junction between the housing and the signal transmission cable, whereby the cable is firmly engaged in the housing, and making the conductor connected with the terminals completely.

1 Claim, 4 Drawing Sheets

CABLE CONNECTOR ASSEMBLY WITH AUXILIARY MECHANISM IN MOLDING PROCESS

BACKGROUND OF THE INVENTION

1. Field of the Invention

The present invention relates to an electrical connector, and more particularly to a cable connector assembly connecting with a cable.

2. Description of the Prior Art

U.S. Pat. No. 6,123,572 issued to Ishii et al. discloses a cable connector used in network communication. The Ishii cable connector comprises a housing, a plurality of conductive terminals received in the housing, and a signal transmission cable electrically connected with the terminals. The housing has a cable insertion end and a mating end opposite to the cable insertion end for mating with another connector. A plurality of terminal channels are defined adjacent to the mating end for receiving the terminals, and a rectangular cavity communicating with the terminal channels extends from the cable insertion end for receiving one end of the cable. In assembly, the cable is inserted into the rectangular cavity from the cable insertion end, and connected with the terminals. However, the cable is circular, there are gaps between the circular cable and the rectangular cavity. During the insert molding process for forming a jacket between the cable and the connector housing, the hot plastic may flow into the terminal channels through the gaps, which may be seriously influence electric performance of the terminals.

Hence, an improved cable connector assembly is needed to overcome the foregoing shortcomings.

BRIEF SUMMARY OF THE INVENTION

A main object of the present invention is to provide a cable connector assembly having a jacket by insert molding process.

Another object of the present invention is to provide a cable connector efficiently preventing plastic flowing into terminal channels during insert-molding process.

A cable connector assembly comprises an insulative housing, a signal transmission cable, two engaging blocks, a plurality of terminals, and a jacket molded on the junction between the housing and the signal transmission cable. The insulative housing comprises a mating end, a cable insertion end, and a cable receiving cavity. Each engaging block comprises a planar top surface, a lower surface in parallel with the top surface, a vertical outside face connecting the top surface with the lower surface, and a concave inside face opposite to the outside face. One end of the signal transmission cable is received in the receiving cavity. The blocks are filled in the cavity and the concave inside face abuts against the outer periphery of the cable. A jacket is molded on the junction between the housing and the signal transmission cable, whereby the cable is firmly engaged in the housing, and making the conductor connected with the terminals completely.

Other objects, advantages and novel features of the invention will become more apparent from the following detailed description when taken in conjunction with the accompanying drawings.

DETAILED DESCRIPTION OF THE INVENTION

Figure 1:
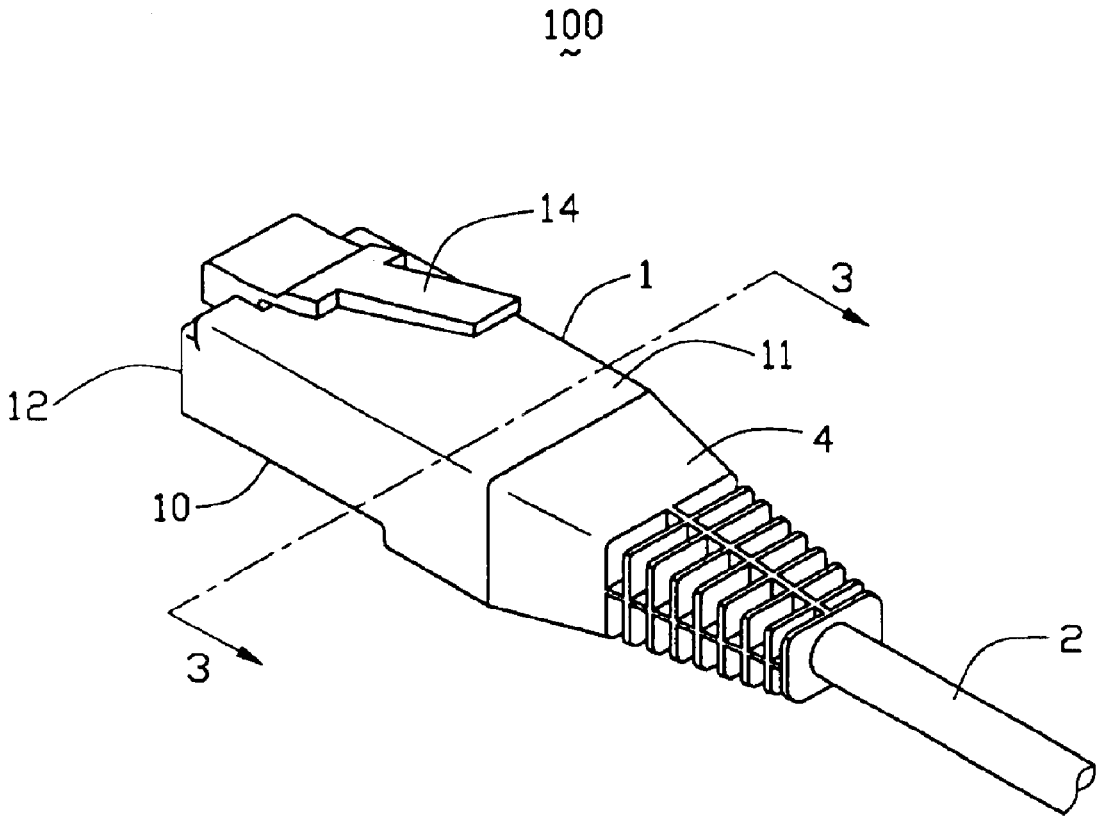
FIG. 1 is a top view of a cable connector assembly in accordance with the present invention.

Referring to FIGS. 1 through 4, a cable connector assembly 100 comprises an insulative housing 1, a signal transmission cable 2, two engaging blocks 3, a plurality of terminals (not shown), and a jacket 4 molded on the junction between the housing 1 and the signal transmission cable 2. The terminals are commonly know in the art, such as terminals disclosed in U.S. Pat. No. 6,123,572 or other types of cable connectors, a detailed description is omitted herein.

Figure 2:
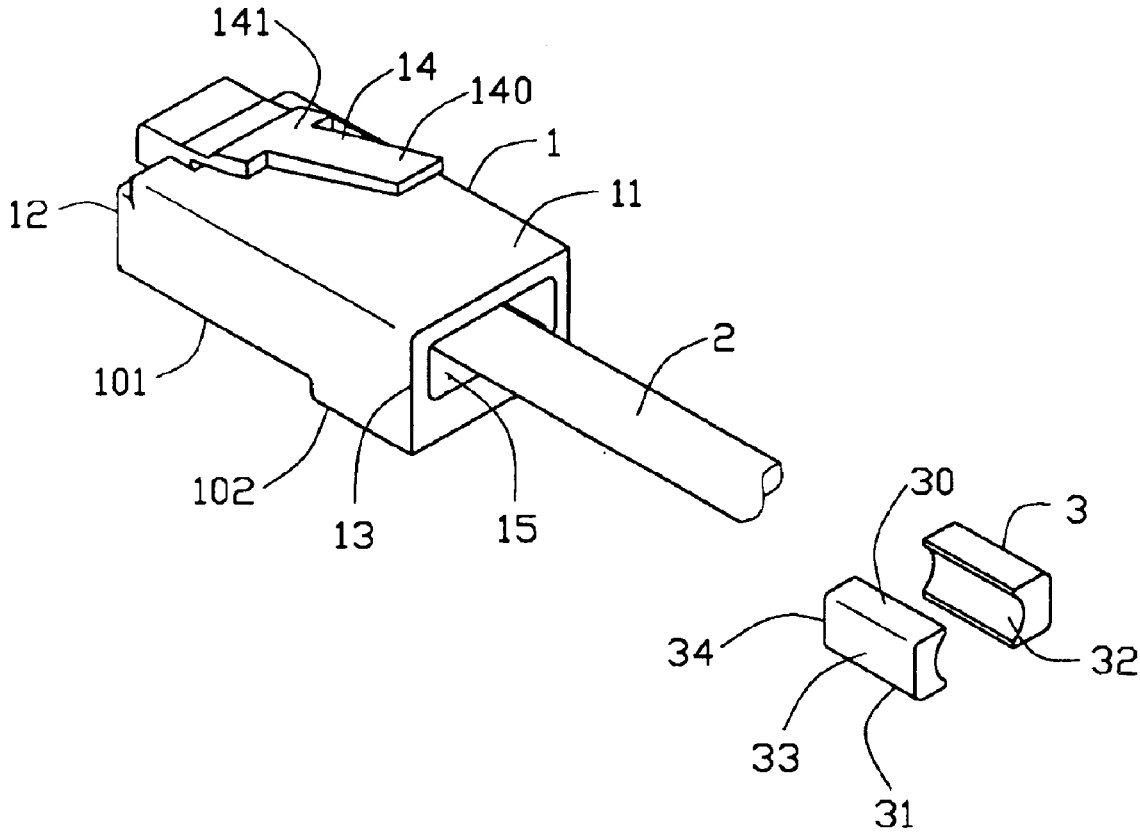
FIG. 2 is an exploded view of the cable connector assembly of FIG. 1, wherein a jacket is not formed yet.
Figure 3:
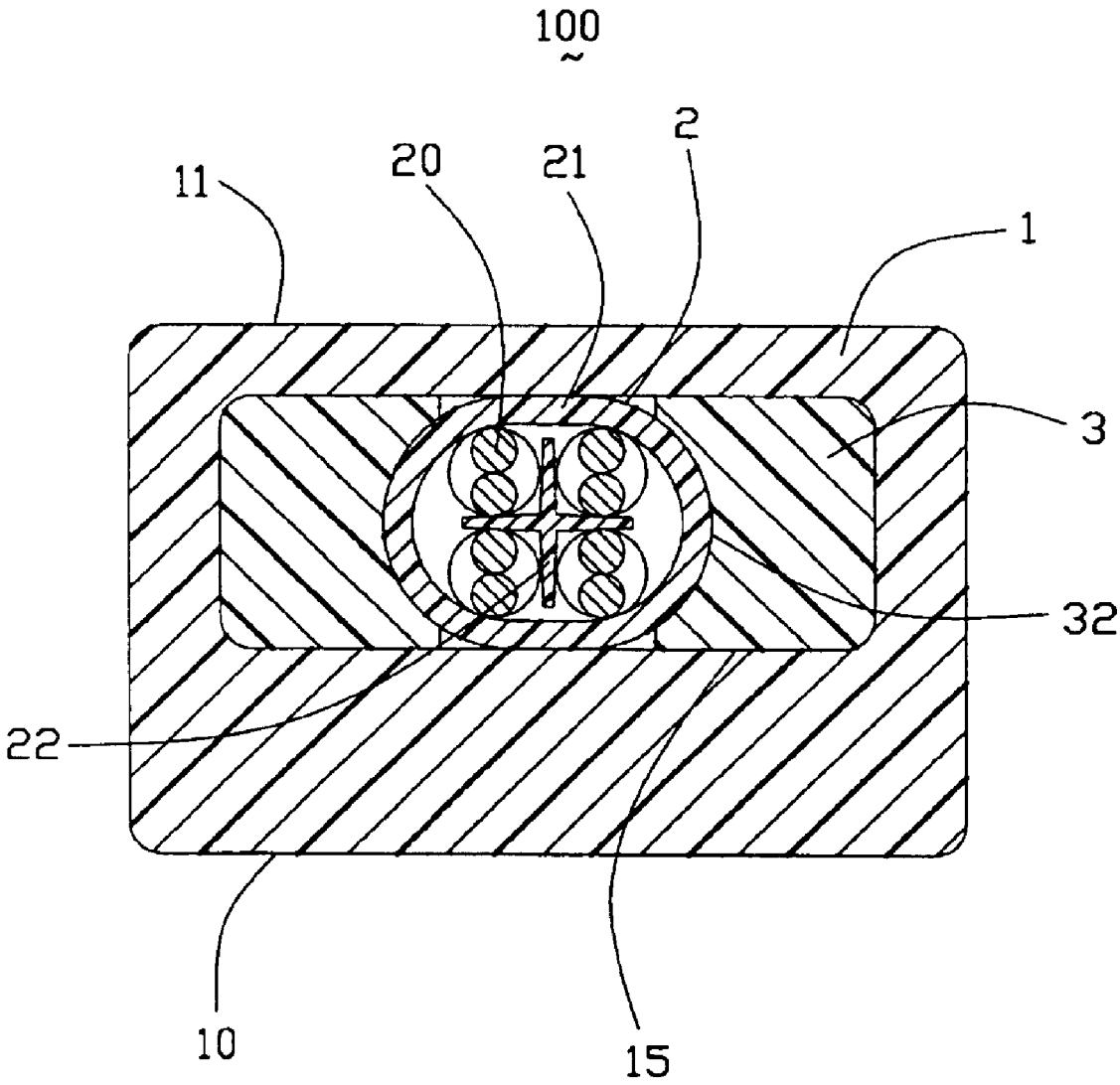
FIG. 3 is a cross section view taken along line 3—3 of FIG. 1.
Figure 4:
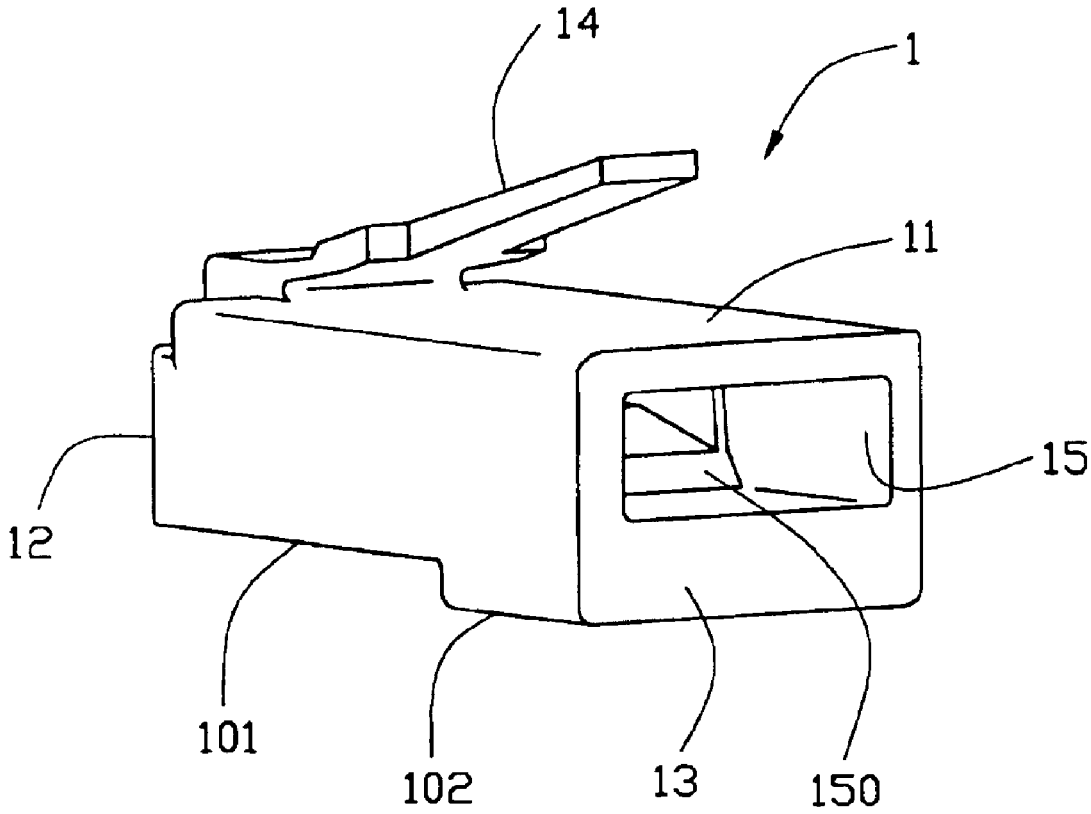
FIG. 4 is a perspective view of a housing of the cable connector assembly in accordance with the present invention.

Referring to FIGS. 2 through 4, the housing 1 has an upper face 10, a bottom face 11, a mating end 12 for mating with a mating connector (not shown), and a cable insertion end 13 opposite to the mating end 12. The upper face 10 defines a raised portion 102 adjacent to the insertion end 13, a lower end 101 adjacent to the mating end 12, a plurality of terminal channels (no shown) defined in the lower end 101 for receiving the terminals therein. The bottom face 11 defines a latch 14 extending rearwardly from the mating end 12 at an angle with the bottom face 11. The latch 14 has an engaging portion 141 adjacent to the mating end 12 for engaging with the mating connector (not shown), and a button portion 140 extending backwardly from the engaging portion 141. The insulative housing 1 further includes a cable receiving cavity 15 in the cable insertion end 13 and communicating with the terminal channels. The cavity 15 has a flat rectangular cross sectional view, and a stop portion 150 around the inner portion for engaging with the mating block 3.

Referring to FIGS. 2 and 3, each block 3 comprises a planar top surface 31, a lower surface 30 in parallel with the top surface 31, a vertical outside face 33 connecting the top surface 31 with the lower surface 30 and an concave inside face 32 opposite to the outside face 33.

Referring to FIG. 3, a signal transmission cable 2 comprises a plurality of signal transmission conductors 20, a support body 22, and an insulative lay 21 wrapping outside the signal transmission conductors 20 and the support body 22. In this embodiment, there are four pairs of signal transmission conductors 20, and the support body 22 is formed from insulative material and presents a X-shaped configuration. Said four pairs of signal transmission conductors 20 are respectively retained in the four corners of the cross-shaped support body 22 respectively, whereby, the cable 2 is not too flexible for assemblying and transmission thereafter.

Referring to FIGS. 1 through 4, in assembly, one end of the signal transmission cable 2 is inserted into the receiving cavity 15 from the cable insertion end 13, and received in the cavity 15. The conductors 20 connect with corresponding terminals received in the terminal channels respectively. The engaging block 3 is inserted into the receiving cavity 15 along the inside wall, and stopped by the stop portion 150. The top surface 30, lower surface 31, and the outside face 33 engage with the inner periphery of cavity 15 and the concave inside face 32 abuts against the outer periphery of the cable 2, whereby the cable 2 is secured between the engaging blocks 3 and the housing 1 with little groove therein. A jacket 4 is molded on the end of the housing 1, and enclosing the cable 2 therein and the cable 2 is firmly engaged in the housing 1, and making the conductor 20 connected with the terminals completely.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing having a plurality of terminal channels and a receiving cavity communicating with the channels;

a plurality of terminals retained in the terminal channels;

a signal transmission cable inserted into the receiving cavity and electrically connecting with the terminals;

an engaging block received in the receiving cavity and abutting against the cable securely; and a jacket molded on the end of the housing and surrounding the cable securely;

wherein said receiving cavity has a rectangular cross-section;

wherein said engaging block includes a concave inner surface mating with an outer periphery of the cable;

wherein said receiving cavity has a stop portion in a front portion thereof for engaging with the engaging block;

wherein said signal transmission cable has a plurality of conductors, a support body, and an insulative layer wrapping outside the conductors and the support body;

wherein said support body presents a X-shaped configuration and forms four corners, said conductors being distributed in the four corners.

* * * * *